US005158101A

United States Patent [19]

Sakka

[11] Patent Number: 5,158,101

[45] Date of Patent: Oct. 27, 1992

[54] NOZZLE DEVICE

[75] Inventor: Toshiaki Sakka, Yokohama, Japan

[73] Assignee: Tosoh Corporation, Shinnanyo, Japan

[21] Appl. No.: 793,940

[22] Filed: Oct. 22, 1991

[30] Foreign Application Priority Data

Oct. 29, 1990 [JP] Japan ..... 2-288454

[51] Int. Cl.[5] ..... B08B 3/02; B08B 9/08

[52] U.S. Cl. ..... 134/167 R; 15/302; 134/172; 134/182; 134/198; 239/124; 239/DIG. 19

[58] Field of Search ..... 239/124, 125, 126, 127, 239/DIG. 19; 15/302; 134/166 R, 167 R, 168 R, 169 R, 172, 182, 198; 141/65, 91, 98

[56] References Cited

U.S. PATENT DOCUMENTS

| | | | |
|---|---|---|---|
| 2,783,765 | 3/1957 | Hagedorn | 15/302 X |
| 4,341,568 | 7/1982 | Christensen | 15/302 X |
| 4,685,480 | 8/1987 | Eck | 15/302 X |
| 4,754,771 | 7/1988 | Tangherlini et al. | 15/302 X |

*Primary Examiner*—Philip R. Coe

*Attorney, Agent, or Firm*—Oblon, Spivak, McClelland, Maier & Neustadt

[57] ABSTRACT

A nozzle device for supplying washing liquid to a reaction vessel holding a carrier therein and for discharging a liquid from the reaction vessel. The nozzle device comprises a cylindrical outer tube having a lower end in a shape of a cone without a vertex and having an axial through-hole in opposition to the reaction vessel and an upper end communicating with a suction device for discharging the liquid. The nozzle device further comprising a cylindrical inner tube inserted loosely in the outer tube, reaching the through-hole of the outer tube, fitting tightly, practically without a gap therebetween, to the axial through-hole at the lower end, and communicating with a washing liquid-supplying device at the upper end thereof to form by itself a supply path for the washing liquid. The nozzle device also includes a liquid discharge path formed between the outside wall of the inner tube and the inside wall of the outer tube. The cone-shaped portion of the outer tube having one or more slits for introducing the liquid from the reaction vessel to the liquid-discharge paths and at least a part of the cone-shaped portion of the outer tube being made of or coated with a fluoro resin.

3 Claims, 3 Drawing Sheets

NOZZLE DEVICE

BACKGROUND OF THE INVENTION

1. Field of the Invention

The present invention relates to a nozzle device for washing the inside of a reaction vessel suitably used for measurement of biochemical reactions such as immune reactions.

2. Description of the Related Art

A micro quantity of a component (hereinafter referred to as an "analyte") is measured in many cases by utilizing a biochemical reaction in which a substance having affinity to the analyte to be measured is employed. One example is a recently developed immune measurement method which measures a micro quantity of a substance in a sample derived from a living body (such as blood, serum, and urea) by utilizing an immune reaction. In this method, the analyte is a component which appears or grows in a living body at the outbreak of a disease such as cancer, and the analyte is detected specifically by an antibody or an antigen. Another example employs a denatured portion of DNA, the main body of gene, as the analyte, in which the measurement is made by using a nucleic acid probe capable of hybridizing with the denatured portion. Any one of these methods includes a step of mixing a substance having affinity to the analyte with a sample containing the analyte, and a final step of measuring a labelled substance which is combined with the substance having affinity to the analyte.

The methods of measurement of the analyte by a biochemical reaction as mentioned above typically include a sandwich method and a competition method. These methods are explained below as specific examples of immune measurement. In the sandwich method, two antibodies (which may be a combination of an antibody with an antigen, or an antigen with an antibody) are mixed with an analyte to form an immune complex composed of three components. Into the one component other than the analyte, a labelling group (e.g., a fluorescent substance, a radioactive isotope, an enzyme, etc.) is introduced which is measurable directly or indirectly by optical means. Then the analyte is measured by an optical signal. On the other hand, in the competition method, a known amount of a preliminarily labelled analyte is added at the bonding reaction of the analyte with a substance having affinity thereto.

The methods explained above employ a labelled substance having affinity to the analyte, or a known quantity of a labelled analyte which has a label detectable directly or indirectly by an optical means. After the bonding reaction, the substance which has not bonded with the analyte needs to be eliminated. For this purpose, one of the substances having affinity to the analyte in the sandwich method, or the substance having the affinity in the competition method is immobilized onto a water-insoluble material (namely a carrier), and thereafter the non-immobilized components is removed. In the procedure, the accuracy is raised by supplying a washing-liquid containing a washing agent, simultaneously with drainage of the reaction liquid, or by other procedure.

The aforementioned step of removal of nonimmobilized components is required not to tend to remove from the biochemical reaction vessel the carrier immobilizing the analyte complex, and not to adversely affect the complex formed on the carrier. For example, Japanese patent application No. Sho 61-157607 describes a nozzle device having a porous filter at the tip portion. With use of this nozzle device, the carrier is pressed by the porous filter at the tip portion, the liquid (reaction liquid) in the vessel is discharged, and a washing liquid is simultaneously supplied to dilute and discharge a remaining component through a discharge-and-feed tube placed at the center of the filter.

The inventors of the present invention conducted an experiment of repeatedly removing a reaction liquid in a reaction vessel with a nozzle device provided with a porous filter. In this experiment, after repetition of about 2000 times of the removal operation, the filter became clogged and the efficiency of reaction liquid removal became lowered. This was presumed to be caused by adherence, to the porous filter, of the substance to be removed such as a labelled substance not having been bonded to the analyte, a substance coming from the sample other than the analyte, or a stabilizer added to improve the efficiency of the biochemical reaction.

SUMMARY OF THE INVENTION

The present invention provides a nozzle device which causes no loss of a carrier from a reaction vessel, gives no adverse effect to the complex on the surface of the carrier, and further causes no adhesion of the above-mentioned components to the nozzle, without lowering the efficiency of the liquid discharge efficiency.

The present invention provides a nozzle device for supplying a washing liquid into a reaction vessel holding a carrier therein and for discharging a liquid from the reaction vessel: the nozzle device comprising a cylindrical outer tube and a cylindrical inner tube, the outer tube having a lower end in a shape of a cone without a vertex and having an axial through-hole in opposition to the reaction vessel and an upper end communicating with a suction means for discharging the liquid; the inner tube being inserted loosely in the outer tube, reaching the through-hole of the outer tube, and fitting tightly, practically without a gap, to the axial through-hole at the lower end, the inner tube communicating with washing liquid-supplying means at the upper end thereof to form by itself a supply path for the washing liquid; a liquid discharge path formed between the outside wall of the inner tube and the inside wall of the outer tube; the cone-shaped portion of the outer tube having one or more slits for introducing the liquid from the reaction vessel to the liquid-discharge path; and at least a part of the cone-shaped portion of the outer tube being made of or coated with a fluoro resin.

DETAILED DESCRIPTION OF THE PREFERRED EMBODIMENT

Figure 1:
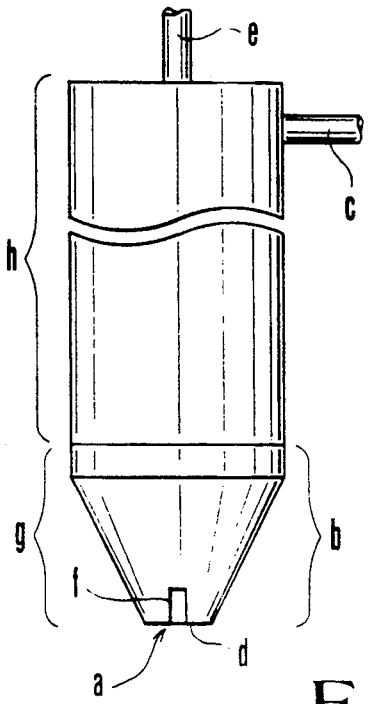
FIG. 1 is an illustration of a nozzle device of the present invention viewed from the lateral side.

In the present invention, the "reaction vessel" refers to the ones which provide a reaction space for causing a biochemical reaction such as an immune reaction of an antigen or an antibody and a hybridization reaction of nucleic acid of DNA or mRNA. Although the nozzle device of the present invention is useful for any type of vessels in principle, the shape of the nozzle device is somewhat limited practically when the nozzle device is used for vessels having an opening of a small diameter or having a complicated shape. Therefore the nozzle device of the present invention is particularly usable for tubular vessels having a nearly constant cross-sectional diameter in height direction with an opening at the top, particularly for round cylindrical vessels. The nozzle device of the present invention is applicable to any carrier which is capable of immobilizing directly or indirectly a component causing a biochemical reaction, and insoluble in water, and has a certain dimension as described above. In particular, the nozzle device of the present invention is preferably used for spherical carrier particles having a diameter larger than about 1 mm.

In the present invention, the feed of a washing liquid to and the discharge of the liquid from a reaction vessel are conducted by the aforementioned duplex tube. The duplex tube portion as a whole is constituted from concentric tubular members having different diameters except the end portion opposed to the vessel. The washing liquid is fed through the inside of the inner tube, and the liquid is discharged through the space between the inside wall of the outer tube and the outside wall of the inner tube. Therefor, the inner tube and the outer tube communicate respectively at the end portion with a washing liquid supply means and a liquid discharge means. These means may be of a usual constitution. A water supply means is constructed, for example, from a tank for the washing liquid, a pump for transporting the washing liquid to the nozzle device, and a valve device between the pump and the nozzle device. A liquid discharge means is constructed, for example, from an apparatus for generating a suction pressure, and a trap bottle for tapping the discharged liquid.

The diameter of the outer tube, in relation to the size of the opening of the reaction vessel, is decided such that the lower end of the nozzle opposed to the vessel can reach the bottom of the vessel. Even with the lower end of the outer tube in a vertex-less cone shape as described above, if the largest diameter portion of the outer tube is larger than the inside diameter of the reaction vessel, the lower end of the outer tube cannot reach the bottom of the vessel and a fraction of the liquid may possibly remain undischarged.

The axial through-hole in the vertex-less cone-shaped portion of the outer tube opposed to the vessel has a diameter substantially equal to the outside diameter of the inner tube. Therefore, the end of the inner tube opposed to the vessel reaches the through-hole and fits tightly to the through-hole practically without a gap. This is not necessarily required if the inner tube is made of a relatively elastic material. Accordingly, the inner diameter of the axis hole of the outer tube should be adjusted in correspondence with the outer diameter of the inner tube.

The tip portion of the outer tube is in a shape of a cone without a vertex, namely a truncated cone, so that it is in a trapezoid shape when viewed from the lateral side. The inner tube is desirably placed so as to completely reach the top side portion of this trapezoid. A slight deviation, however, is allowable: a state that the inner tube is recessed slightly in the opening of the outer tube, or protrudes from the opening. A cone-shaped portion of the outer tube is preferably inclined to the axis at an angle of from 5° to 30°. A larger or smaller angle than this may decrease of the effect described later.

Except the cone-shaped portion of the outer tube and the fitting portion of the inner tube with the outer tube, the tubes need not necessarily be a cylindrical tube, but may be a polygonal tube. However, a cylindrical shape is preferred.

In the cone-shaped portion of the outer tube, one or more slits are formed to introduce the liquid in the vessel into the liquid discharge path formed by the gap between the inside wall of the outer tube and the outside wall of the inner tube. The breadth of the slit needs to be less than the minor axis dimension of the carrier particles in order to prevent the intrusion of the carrier particles into the discharge path. With such a construction, however, if the slit breadth is large, the carrier may possibly be sucked and kept attracted at the slit portion by the suction pressure at the discharge. Accordingly, the slit breadth is preferably not larger than 1/5 of the minor axis dimension of the carrier particles. The slit is formed from the axis hole at the lower end opposed to the vessel in the nozzle axis direction. The length of the slit in the nozzle axis direction (namely the height thereof) is not specially limited, but preferably is not less than the minor axis dimension of the carrier particles. With an excessive height of the slit, air is introduced from the slit as the liquid level is lowered in the vessel (in a state that the feed of the washing liquid is stopped) to lower the suction pressure and to cause incomplete drainage and remaining of the liquid. On the contrary with insufficient height, the initial suction pressure is maintained, which may attract the carrier particles to the slit. This simultaneously means that the user of this device can control the sucking pressure at the completion of the liquid removal by intentionally changing the slit height.

Although one or more slits may be useful, 3 to 8 slits or thereabout are formed preferably at regular intervals for more effective drainage. Formation of an excessive number of slits may cause insufficient strength of the hole of the outer tube, resulting in disadvantage of deformation of the device. Accordingly, the number of the slits is preferably within the aforementioned range.

In the nozzle device of the present invention, the cone-shaped portion of the outer tube is constructed from or coated with a fluoro resin, which enables the prevention of the adhesion of a component in the reaction vessel onto the nozzle device. More preferably, other portions which will be brought into contact with the liquid to be sucked and discharged, namely the portions including the inside wall of the outer tube other than the cone-shaped portion, and the outside wall of the inner tube, are similarly constructed from or coated with the fluoro resin. The fluoro resin includes tetrafluoroethylene, trifluoroethylene, and the like. The other portions of the nozzle device excluding the cone-shaped portion may be made from any material which is stable to the reactants employed in the biochemical reaction. The material includes silicone rubber, stainless steel, polypropylene, polyethylene, polyacetal, and the like.

The nozzle device of the present invention may be mounted on a transfer apparatus and be driven thereby in use. When the opening of the reaction vessel is at a top portion, the nozzle device is mounted on a vertically driving transfer apparatus to insert the nozzle device from the top direction. The transfer apparatus is designed on the basis of the transfer distance and so forth depending on the liquid suction ability of the nozzle device, and the relative position of the outer tube of the nozzle device to the bottom of the reaction vessel. Further in order to improve the washing efficiency of the nozzle device, the transfer apparatus for the nozzle device is preferably constructed so as to be capable of driving also in a direction perpendicular to the nozzle-inserting direction. The above-mentioned transfer apparatus may be the one which drives the reaction vessel vertically and horizontally.

Therefore, a transfer apparatus having a function of stopping the transfer operation when the nozzle device has attracted carrier particles located at the position of the tip of the nozzle device, is preferred to one which mechanically drives the nozzle device to the bottom of the vessel.

The nozzle device of the present invention is composed of at least two members of an outer tube member for constructing the outer tube and an inner tube member for constructing the inner tube. In preparing the nozzle device more simply, the cone-shaped end portion of the outer tube may be separately prepared from a fluoro resin, and be simply fit into a member constituting a duplex tube comprising an outer tube and an inner tube.

The nozzle device of the present invention is suitably used, for example, for the aforementioned removal operation called "B/F separation" in measurement of an antigen concentration, which measurement comprises steps of immobilizing an antibody on an insoluble carrier; forming a complex of the antibody with the antigen (analyte) to be measured; reacting an antibody (to the antigen) labelled with an optically detectable substance with the above complex; removing the excess of the labelled antibody not having been bonded indirectly to the carrier; detecting the labelled substance to measure the concentration of the antigen. In particular, the nozzle device of the present invention is capable not only of sucking the liquid in the vessel but also of feeding a suitable washing solution simultaneously or separately through the inner tube.

In the aforementioned immune measurement, for example, the measured data will involve a large error unless the labelled substance not bonded to the carrier is removed effectively by washing. Thus the nozzle device needs to satisfy the requirements of not having the carrier adhered thereon, not discharging the carrier out of the vessel, not adversely affecting the complex formed by a biochemical reaction, and not being clogged readily by the component to be removed, even after the washing operation is repeated several thousand times. If the nozzle device is clogged, the washing efficiency is naturally lowered and the washing operation takes longer time or, in the worst case, becomes impractible. The longer the operation time, the fewer is the number of the treatable or measurable samples, which is against the user's desire to carry out measurement of a larger number of the sample in shorter time. Although the nozzle device may be washed or exchanged at a predetermined time interval in order to avoid the clogging, such maintenance should be reduced to the minimum.

The nozzle device of the present invention has the end of the outer tube opposed to the vessel in a cone shape without a vertex, and has a slit or slits for sucking the liquid, which has not ever been practiced. This prevents the adhesion of spherical carrier particles on the tip, and simultaneously decreases utmost the contact (or friction) of the descending nozzle device with the carrier particles to exclude any influence on the complex. Further, the fluoro resin constituting or coating the cone-shaped portion prevents adhesion of the component to be removed.

In inserting the nozzle device to the bottom of the reactor vessel, the carrier particles are desired to be excluded from the nozzle insertion path. The nozzle device of the present invention, which is capable of feeding the washing liquid and sucking the liquid, can reduce the contact (or friction) with the carrier as described above, and furthermore can exclude the carrier particles from the path by gushing the washing liquid simultaneously with the insertion of the nozzle device.

In the case where the nozzle device is not inserted to the bottom of the reaction vessel, the contact area between the slit or slits and the liquid becomes smaller, causing undesired air introduction and decrease of the suction pressure, and liquid may be removed incompletely and remain unremoved. Practically, however, as the liquid is sucked, the gaps between a plurality of carrier particles having moved to the vicinity of the nozzle by the action of the liquid flow will serve as openings for introducing the liquid into the nozzle derivative, giving sufficient suction effect. Accordingly, the nozzle device of the present invention is particularly effective for washing the vessel holding a plurality of carrier particles having nearly equal diameters.

In the nozzle device of the present invention, since the one end portion of the outer tube is cone-shaped, the flow velocity of the discharging liquid is higher at the inside of this portion in comparison with that in the other portions including the duplex tube portion constructed from a circular or polygonal outer tube and a circular or polygonal inner tube, which prevents the adhesion of the component to be removed onto the inside wall of the cone-shaped portion. Further, by adjusting the breadth and the height of the slit, the suction power can be controlled at the initial stage of suction (where the entire of the slit is in the liquid to be sucked) and at the final stage of suction (where the liquid to be sucked is almost removed), or the suction power can be gradually decreased by introducing air into the slit as the liquid level in the vessel becomes lower.

The nozzle device of the present invention is described in detail by reference to the drawings and the results of washing experiments, when applied to an enzyme immune measurement apparatus.

FIG. 1 is an illustration of the nozzle device of the present invention viewed from a lateral side. In this drawing, a reaction vessel is to be placed below the nozzle device. The one end of the outer tube opposed to the vessel is in a shape of a cone (b) having no vertex with an axial through-hole (a), and the other end communicates with a liquid suction apparatus (c) not shown in the drawing. The one end of the inner tube opposed to the vessel reaches the end of the cone portion (d), while the other end communicates with a washing liquid supply apparatus (e) not shown in the drawing. The end of the outer tube opposed to the vessel has slits (f), four slits in this drawing, at the opening of the cone-shaped portion of the outer tube in the direction of the axis.

In the example of this drawing, tip portion (g) of the nozzle device opposed to the vessel has the same diameter as that of the simple duplex tube portion (h). However, the tip portion may be narrower or thicker than the duplex tube portion.

Figure 2:
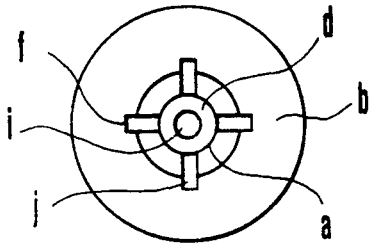
FIG. 2 is an illustration of a nozzle device of the present invention viewed from the lower side (from of the reaction vessel side).

FIG. 2 is an illustration of a nozzle device of FIG. 1 viewed upward from the reaction vessel side. The one end (d) of the inner tube fits tightly into the axial through-hole (a) of the cone-shaped portion of the outer tube without a gap. The outer tube has four slits (f) extending from the opening in the axis direction. The axial through-hole (a) or the outer tube fits tightly to the end of the inner tube actually without a gap. In this drawing, the end faces of the outer tube and the inner tube are hatched for better understanding of the nozzle device of the present invention.

Figure 3:
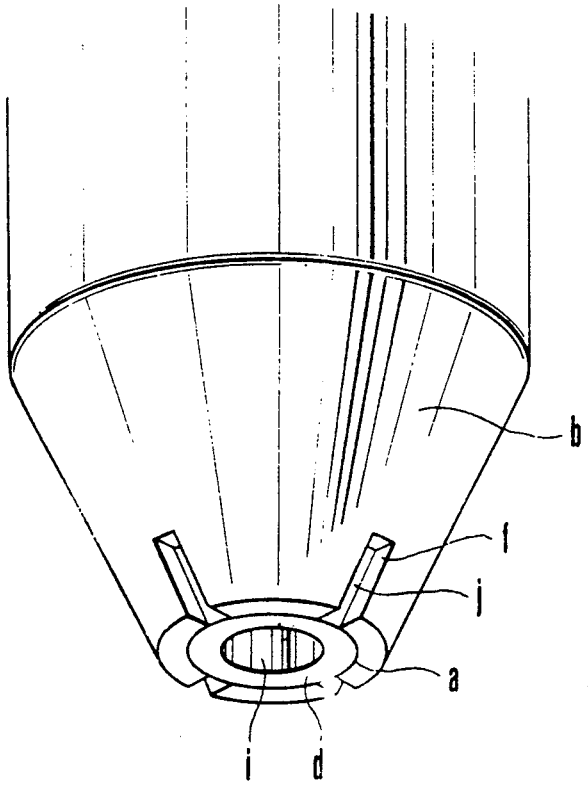
FIG. 3 is an illustration of a nozzle device of the present invention viewed from the lower side obliquely.

FIG. 3 is an illustration of the end of the nozzle device shown in FIG. 1 and FIG. 2, viewed obliquely upward from the side of the reaction vessel. The inner tube (d) fits to the axial through-hole (a) at the cone-shaped portion of the outer tube, serving as the feeding path (i) for the washing liquid. Four slits (f) are provided around the axial through-hole, which serve as introducing inlets (j) into the nozzle for the liquid to be removed. In this drawing also, the end faces of the outer tube and the inner tube are hatched.

Figure 4:
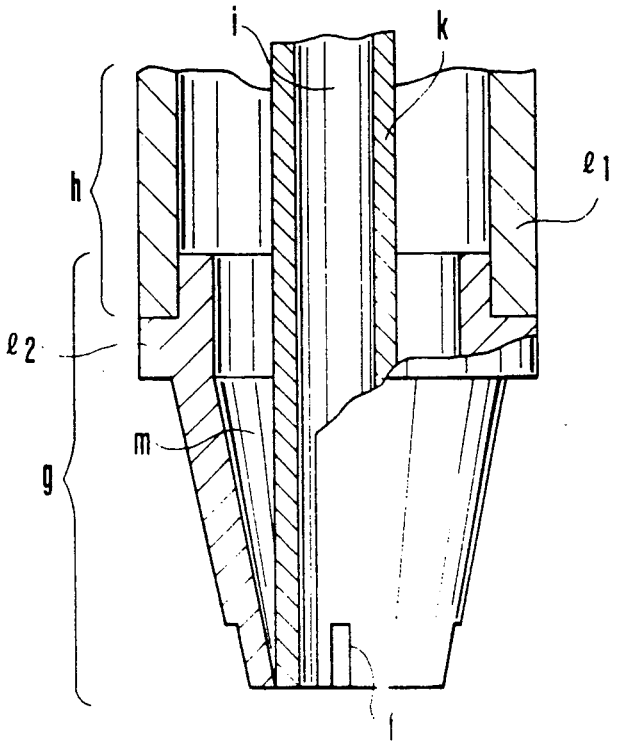
FIG. 4 is a partial sectional view of a nozzle device of the present invention along the axis of the device.

FIG. 4 is a partial sectional view of the end portion of the nozzle device opposed to the reaction vessel. The construction of this example is effective in the case where the duplex tube portion (h) and the tip (g) of the cone-shaped portion are prepared separately, and then combined to complete the device. When only the cone-shaped portion of the outer tube is made of a fluoro resin, this portion is preferably made separable. The wall thicknesses and other dimensions of the inner tube (k) and the outer tub ($l_1$, $l_2$) are not specially limited. The diameter of the outer tube, etc. should be decided in sufficient consideration of the discharging path (m) formed by the outer tube and the inner tube inserted therein for the liquid to be removed.

Figure 5A:
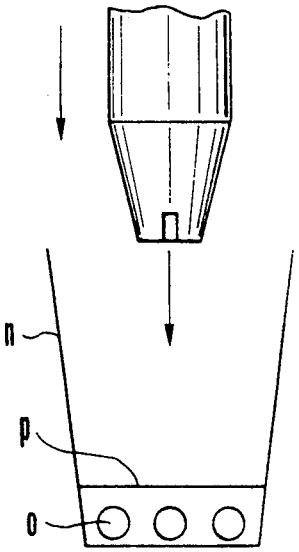
FIG. 5 is schematic views of washing a vessel holding spherical carriers by use of a nozzle device of the present invention.
Figure 5B:
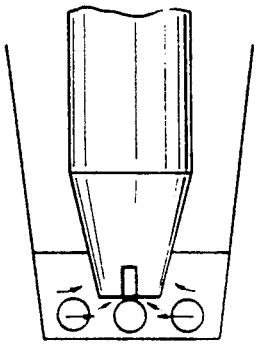
Figure 5C:
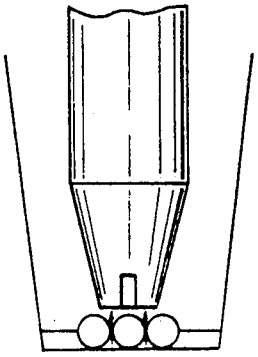

FIGS. 5(A)-5(C) illustrate states of washing of a reaction cup with the nozzle device of the present invention. FIG. 5(A) illustrates a state of supplying the washing solution to the reaction vessel (n) from the nozzle device staying at a certain distance from the reaction vessel. FIG. 5(B) illustrates a state at the start of the liquid removal with the nozzle device having been lowered by a transfer means not shown to come into contact with carrier (o). FIG. 5(C) illustrates a state at the completion of the liquid removal.

As shown in FIGS. 5(A)-5(C), the carrier particles, particularly those spherical in the shape, are sucked to the center, and consequently the gaps between the particles serves as a liquid-introducing path even at a low liquid level (p) at a low sucking pressure resulting from the removal of the liquid. Accordingly, effective suction can be achieved surprisingly even with the reduced contact area between the slits and the liquid. Therefore, the nozzle device of the present invention is particularly preferably used for the washing of the reaction vessel holding therein spherical carrier particles.

Although FIGS. 5(A)-5(C) show an example in which the feed of the washing liquid and the suction of the liquid are conducted separately, these operations may be simultaneously conducted.

Figure 6:
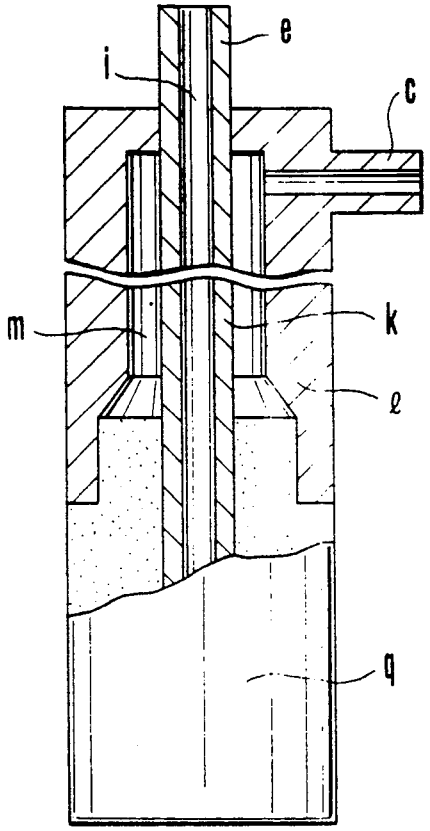
FIG. 6 illustrates a comparative nozzle device employed in comparative experiments.

FIG. 6 shows a comparative nozzle device employed in the experiment described later. The structure including the duplex tube is the same as that of the present invention except that a porous filter (q) is fitted up at the end of the duplex tube opposed to the vessel. In this drawing, the upper end (c) of the outer tube is shown which is opposite to the end opposed to the vessel and connects the nozzle device to the liquid suction apparatus (not shown in the drawing). Such a construction is also applicable in the nozzle device of the present invention.

Figure 7:
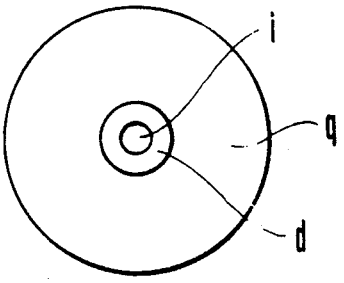
FIG. 7 is an upward view of the comparative nozzle device of FIG. 6 observed from the reaction vessel side.

FIG. 7 is an illustration of the apparatus of FIG. 6 viewed from the reaction vessel side.

REACTION VESSEL WASHING EXPERIMENT 1

A nozzle device was employed which has an external appearance like the one illustrated in FIG. 1. This device was constructed by preparing the cone-shaped portion separately as shown in FIG. 4.

The details of the nozzle device are as below:

Inner Tube (cylindrical)
- Material: tetrafluoroethylene
- Inside diameter: 0.4 mm
- Outside diameter: 1.4 mm
- Thickness: 0.5 mm
- Length: 10 cm Outer Tube ($l_1$ Portion) (See FIG. 4 as to the $l_1$ portion)
- Material: polypropylene
- Inside diameter: 4 mm
- Outside diameter: 5.5 mm
- Thickness: 0.75 mm
- Length: 9 cm Outer Tube ($l_2$ Portion) (See FIG. 4 as to the $l_2$ portion)
- Material: tetrafluoroethylene
- Length: 7 mm (2 mm thereof corresponding to fitting portion in $l_1$ portion)
  - (Largest portion)
  - Inside diameter: 3 mm
  - Outside diameter: 5.5 mm
  - Thickness: 1.25 mm
  - (Smallest portion)
  - Inside diameter: 1.4 mm
  - Outside diameter: 2.4 mm
  - Thickness: 0.5 mm
  - Slits: four in number
  - Breadth: 0.3 mm
  - Length: 1.5 mm
  - Inclination angle of cone-shaped portion: about 9° to the axis The nozzle device employed for comparison was a device provided at the tip thereof with a porous filter through which an inner tube serving as the feeding path for the washing liquid penetrates as described in Japanese patent application No. Sho 61-157607, and as shown in FIGS. 6 and 7. In the comparison experiments, a nozzle device was employed which is provided with a ceramic filter having a length of 5 mm, an outer diameter of 5.5 mm and a through-hole of diameter of 1.4 mm in place of the above-mentioned cone-shaped portion of the outer tube. The filter portion of this device had a protrusion portion having a diameter of 4 mm and a height of 2 mm, and having a penetration hole of 1.4 mm in diameter. The filter portion was attached by fitting the protrusion portion into the $l_1$ portion of the outer tube.

The experiments were conducted with the above-described two kinds of the nozzle devices. A solution of 10 mg of gelatin in 0.1 ml of bovine serum was placed and stirred in a reaction vessel made of polypropylene (cylinder shape, diameter: 10 mm, height: 20 mm) holding therein 6 glass beads of 2 mm in diameter.

The nozzle device was inserted down to the point of 20 mm from the bottom face of the reaction vessel, and 0.6 ml of washing solution was added to the vessel through the inner tube of the nozzle device. Then the nozzle device was lowered such that the tip of the nozzle came into contact with the glass beads, and the liquid in the vessel was sucked out. This washing operation was repeated eleven times. In the experiments, the nozzle device was placed above the center point of the vessel bottom. The washing solution was prepared by adding 1.1 g of mono-lauric acid polyoxyethylenesorbitane and 14.6 g of sodium chloride to 2.5 l of purified water.

Thereafter, the quantity of the unremoved bovine serum component in the reaction vessel was measured by adding 4-methylunbelliferyl phosphate (4MUP) which is a specific substrate for alkaline phosphatase (ALP) contained in the bovine serum and measuring subsequently the decomposed 4MUP.

For the measurement, 0.2 ml of the reaction liquid containing 1 mM of 4MUP was added to the reaction vessel having been washed as above. After 40 minutes of incubation, the 4MUP was determined at exciting wavelength of 360 nm and detecting wavelength of 450 nm by use of a fluorescence detector of a commercial immune measurement apparatus (AIA-1200 (trade name), made by Tosoh Corporation) according to a "Rate" method.

The above experiment was conducted for 500 reaction vessels per lot and 3000 reaction vessels in total. The measured value of above 3 nM/sec was recognized as "poorly washed". The lot in which no vessel was recognized as "poorly washed" was evaluated as being well washed (represented by "good"); the lot in which 1 to 5 reaction vessels were recognized as "poorly washed" was evaluated as being practically washed (represented by "practical"); and the lot in which 6 or more reaction vessels were recognized as "poorly washed" was evaluated as being poorly washed and impractical (represented by "poor").

The results are shown in the Table. With the nozzle device of the present invention, washing was satisfactorily practiced for 3000 reaction vessels of 6 lots. On the contrary, with the nozzle device for comparison, the washing efficiency decreased after washing of 1500 reaction vessels of 3 lots and cleaning or exchange of the filter is required for practical immune measurement.

TABLE

| Number of reaction vessel | Nozzle device | |
|---|---|---|
| | Present invention | Comparison |
| to 500 | good | good |
| to 1000 | good | good |
| to 1500 | good | good |
| to 2000 | good | practical |
| to 2500 | good | poor |
| to 3000 | good | poor |

REACTION VESSEL WASHING EXPERIMENT 2

The same experiment as Experiment 1 above was conducted with the nozzle device of the present invention used in Experiment 1 and a comparative nozzle device in a form of a simple duplex tube constituted of an inner stainless steel tube (inner diameter: 0.4 mm, outer diameter: 1.4 mm, thickness: 0.5 mm, length: 10 cm) and an outer tube (material: polypropylene, inner diameter: 4 mm, outer diameter: 5.5 mm, thickness; 0.75 mm, length; 10 cm). The comparative duplex tube device was not clogged by deposit, but occasionally attracted the carrier particle of glass sphere of 2 mm in diameter at the end of the outer tube, taking the carrier particle out of the vessel on transferring the nozzle device out of the vessel.

What is claimed is:

1. A nozzle device for supplying washing liquid to a reaction vessel holding a carrier therein and for discharging a liquid from the reaction vessel, the nozzle device comprising:

a cylindrical outer tube comprising a lower end in a shape of a cone without a vertex and an axial through-hole in opposition to the reaction vessel, said cylindrical outer tube further comprising an upper end communicating with suction means for discharging the liquid;

a cylindrical inner tube inserted loosely in the outer tube, said cylindrical inner tube reaching the through-hole of the outer tube and being tightly fitted, with practicaly no gap therebetween, to the through-hole at the lower end, said cylindrical inner tube communicating with washing liquid-supplying means at the upper end thereof to form a supply path for the washing liquid; and a liquid discharge path formed between an outside wall of the inner tube and an inside wall of the outer tube;

wherein:

the cone-shaped lower end of the outer tube comprises one or more slits for introducing the liquid from the reaction vessel to the liquid-discharge path; and at least a part of the cone-shaped lower end of the outer tube is made of or coated with a fluoro resin.

2. The nozzle device according to claim 1, wherein the fluoro resin is tetrafluoroethylene or trifluoroethylene.

3. The nozzle device according to claim 1, wherein the slit or slits have a breadth of not larger than 1/5 of the minor axis dimension of a particle of the carrier.

* * * * *